US007057446B2

(12) United States Patent
Choi et al.

(10) Patent No.: US 7,057,446 B2
(45) Date of Patent: Jun. 6, 2006

(54) REFERENCE VOLTAGE GENERATING CIRCUIT AND INTERNAL VOLTAGE GENERATING CIRCUIT FOR CONTROLLING INTERNAL VOLTAGE LEVEL

(75) Inventors: Jong-hyun Choi, Suwon (KR); Jae-hoon Kim, Suwon (KR); Jun-hyung Kim, Yongin (KR); Chi-wook Kim, Kyungki-do (KR); Han-gu Sohn, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/726,095

(22) Filed: Dec. 2, 2003

(65) Prior Publication Data

US 2004/0108890 A1 Jun. 10, 2004

(30) Foreign Application Priority Data

Dec. 2, 2002 (KR) ..... 10-2002-0075806
Sep. 17, 2003 (KR) ..... 10-2003-0064584

(51) Int. Cl.
*G05F 1/46* (2006.01)
*G05F 3/08* (2006.01)

(52) U.S. Cl. ..... 327/541; 327/543

(58) Field of Classification Search ..... 327/540, 327/541, 543; 323/311

See application file for complete search history.

(56) References Cited

U.S. PATENT DOCUMENTS 5,532,578 A 7/1996 Lee ..... 323/313
6,166,589 A * 12/2000 Park ..... 327/540
6,429,729 B1 * 8/2002 Kobayashi et al. ..... 327/540
6,480,427 B1 * 11/2002 Kuriyama ..... 365/189.11
6,548,994 B1 * 4/2003 Jang ..... 323/313

(Continued)

FOREIGN PATENT DOCUMENTS

DE CH 623 671 A5 7/1977
DE 197 27 789 A1 5/1998

(Continued)

*Primary Examiner*—Timothy P. Callahan
*Assistant Examiner*—Terry L. Englund
(74) *Attorney, Agent, or Firm*—F. Chau & Associates, LLC

(57) ABSTRACT

Provided are a reference voltage generating circuit and an internal voltage generating circuit for controlling an internal voltage level, where the reference voltage generating circuit includes a distributing unit, a clamping control unit, and a control unit; the distributing unit has a voltage level lower than that of an external power supply voltage in response to the external power supply voltage, and outputs via an output terminal a reference voltage which varies according to an operating mode; the clamping control unit is connected between the output terminal and a ground voltage, and clamps the voltage level of the reference voltage at a constant level in response to a control voltage having a voltage level which is lower than that of the reference voltage; the control unit increases or decreases the voltage level of the reference voltage in response to first and second operating mode signals; the control unit includes a first control transistor and a second control transistor; and the reference voltage generating circuit controls a reference voltage level according to an operating mode of the semiconductor memory device such that the operating characteristics of the semiconductor memory device can be improved in some operating modes and power dissipation can be minimized in other operating modes.

14 Claims, 4 Drawing Sheets

U.S. PATENT DOCUMENTS

| | | | | |
|---|---|---|---|---|
| 6,593,779 | B1 * | 7/2003 | Shokouhi et al. | 327/68 |
| 6,788,132 | B1 * | 9/2004 | Lim et al. | 327/540 |
| 6,809,576 | B1 * | 10/2004 | Yamasaki | 327/540 |
| 6,836,104 | B1 * | 12/2004 | Yoshihara | 323/314 |

FOREIGN PATENT DOCUMENTS

| | | |
|---|---|---|
| DE | 197 11 364 A1 | 9/1998 |
| KR | 2000-0060957 | 10/2000 |

* cited by examiner

REFERENCE VOLTAGE GENERATING CIRCUIT AND INTERNAL VOLTAGE GENERATING CIRCUIT FOR CONTROLLING INTERNAL VOLTAGE LEVEL

CROSS-REFERENCE TO RELATED APPLICATIONS

This application claims foreign priority under 35 U.S.C. § 119 to Korean Patent Application No. 02-75806 filed on Dec. 2, 2002, in the Korean Intellectual Property Office, and to Korean Patent Application No. 03-64584 filed on Sep. 17, 2003, in the Korean Intellectual Property Office.

BACKGROUND OF THE INVENTION

1. Field of the Invention

The present invention relates to semiconductor memory devices, and more particularly, to voltage generating circuits of a semiconductor memory device that are responsive to an operating mode.

2. Description of the Related Art

Recent technologies for fabricating semiconductor memory devices have become increasingly hyperfine and highly integrated. Thus, semiconductor memory devices having low power consumption are required. To reduce the power consumption, a power supply voltage to be applied to the semiconductor memory devices may be lowered.

Thus, a conventional semiconductor memory device includes an internal voltage generating circuit for supplying a power supply voltage from an external circuit using a power supply voltage of about 5 V to an internal circuit using a low power supply voltage of about 3.3 V. The internal voltage generating circuit generates an internal voltage in response to a reference voltage received from a reference voltage generating circuit.

In conventional semiconductor memory devices, operating modes are classified according to frequency range. Such operating modes are explained in relation to column address strobe ("CAS") latency. The CAS latency ("CL") is a time required for outputting data after a read command is input. That is, when a read command is input at a certain point of a clock signal and then data is output two cycles of the clock signal later, the operating mode is defined for a CAS latency of 2, and becomes, namely, "CL2".

When a read command is input at a certain point of the clock signal and then data is output three cycles of the clock signal later, the operating mode becomes CL3. Likewise, when a read command is input at a certain point of the clock signal and then data is output two and a half cycles of the clock signal later, the operating mode becomes CL2.5.

If a semiconductor memory device is in the operating frequency range of about 100 to 133 MHz, the device operates in CL2 mode. If a semiconductor memory device is in the operating frequency range of about 166 to 200 MHz, the device operates in CL3 mode.

However, in conventional semiconductor memory devices, an internal voltage is maintained at a constant level regardless of the operating mode, or CL. Thus, when the semiconductor memory device is in an operating mode of a relatively low frequency range, it suffers from unnecessarily increased power dissipation.

Also, even if the internal voltage level of the semiconductor memory device is lowered in order to reduce the power dissipation, operating characteristics may be degraded in an operating mode of a higher frequency range, for example.

Thus, with conventional semiconductor memory devices, if an internal voltage level is controlled in order to improve the operating characteristics of a semiconductor memory device in a certain operating mode, the device may suffer from unnecessarily increased power dissipation in other operating modes.

SUMMARY OF THE INVENTION

The above-described and other drawbacks and disadvantages of the prior art are addressed by a semiconductor memory device that provides a reference voltage generating circuit by which an internal voltage level of the device can be controlled according to an operating mode. Embodiments of the present invention also provide an internal voltage generating circuit by which an internal voltage level of a semiconductor memory device can be controlled according to an operating mode.

In accordance with a first aspect of the present invention, there is provided a reference voltage generating circuit comprising a distributing unit, a clamping control unit, and a control unit.

The distributing unit outputs via an output terminal a reference voltage, which has a voltage level lower than that of an external power supply voltage and varies according to an operating mode, in response to the external power supply voltage.

The clamping control unit is connected between the output terminal and a ground voltage, and clamps a voltage level of the reference voltage at a constant level in response to a control voltage which is lower than the reference voltage.

The control unit increases the voltage level of the reference voltage in response to a first operating mode signal and decreases the voltage level of the reference voltage in response to a second operating mode signal.

The distributing unit includes a first resistor, a second resistor, and first through fourth transistors. The first resistor is connected between the external power supply voltage and the output terminal. The second resistor is connected between the output terminal and a first node from which the control voltage is output.

The first through fourth transistors are connected in series between the first node and the ground voltage. The gates of the first through third transistors are connected to the output terminal, and the external power supply voltage is applied to the gate of the fourth transistor.

The first through fourth transistors are NMOS transistors. The voltage level of the reference voltage is controlled by controlling a width-to-length ("W/L") ratio of each of the first through fourth transistors.

The control unit includes a first control transistor and a second control transistor. The first control transistor is turned on or turned off in response to the first operating mode signal to increase or decrease the reference voltage level. The second control transistor is turned on or turned off in response to the second operating mode signal to increase or decrease the reference voltage level.

The first control transistor is an NMOS transistor. The source and drain of the NMOS transistor are connected to the source and drain of the first transistor, respectively, and the first operating mode signal is applied to the gate thereof.

The second control transistor is an NMOS transistor. The source and drain of the NMOS transistor are connected to the source and drain of the third transistor, respectively, and the second operating mode signal is applied to the gate thereof.

The clamping control unit is a PMOS transistor. The first and second ends of the PMOS transistor are connected to the output terminal and the ground voltage, respectively, and the control voltage is applied to the gate thereof. The first and second operating mode signals are mode register set ("MRS") signals.

When the reference voltage generating circuit is in a low operating frequency range, the first and second operating mode signals are at a first level. When the reference voltage generating circuit is in a high operating frequency range, the first and second operating mode signals are at a second level. Also, when the reference voltage generating circuit is in an intermediate operating frequency range, one of the first and second operating mode signals is generated at the first level, and the other is generated at the second level.

In accordance with a second aspect of the present invention, there is provided an internal voltage generating circuit comprising a differential amplifier unit, a distributing unit, and a control unit.

The differential amplifier unit compares a voltage level of a reference voltage with a voltage level of an internal voltage, generates a control signal in response to a comparison result, and controls the voltage level of the internal voltage.

The distributing unit increases or decreases the voltage level of the internal voltage in response to the control signal to clamp the voltage level of the internal voltage at a constant level. The control unit increases the voltage level of the internal voltage in response to a first operating mode signal and decreases the voltage level of the internal voltage in response to a second operating mode signal.

The differential amplifier unit comprises a first transistor having a first terminal connected to an external power supply voltage and having the gate and a second terminal, which are connected to each other; a second transistor having a first terminal connected to the external power supply voltage, the gate connected to the gate of the first transistor, and a second terminal from which the control signal is output; a third transistor having a first terminal connected to the second terminal of the first transistor, the gate connected to the internal voltage, and a second terminal connected to a first node; a fourth transistor having a first terminal connected to the second terminal of the second transistor, the gate connected to the reference voltage, and a second terminal connected to the first node; and a fifth transistor connected between the first node and a ground voltage and having the gate to which a switching signal is applied.

The distributing unit includes first through third distributing transistors. A first terminal of the first distributing transistor is connected to an external power supply voltage, and the control signal is applied to the gate thereof. A first terminal of the second distributing transistor is connected to a second terminal of the first distributing transistor, and the control signal is applied to the gate thereof.

A first terminal of the third distributing transistor is connected to a second terminal of the second distributing transistor, and the control signal is applied to the gate thereof. Also, a second terminal of the third distributing transistor is connected to the internal voltage.

The control unit includes first and second control transistors. The first control transistor is turned on or turned off in response to the first operating mode signal to increase or decrease the internal voltage level. The second control transistor is turned on or turned off in response to the second operating mode signal to increase or decrease the internal voltage level.

In accordance with a third aspect of the present invention, there is provided an internal voltage generating circuit comprising a voltage level detecting unit and a boosting unit.

The voltage level detecting unit determines a voltage level of a first voltage in response to first and second operating mode signals, compares the voltage level of the first voltage with a voltage level of a second voltage, and controls a voltage level of an internal voltage which is higher than a voltage level of an external power supply voltage.

The boosting unit increases or decreases the voltage level of the internal voltage in response to a control signal, which is generated in response to results of a comparison of the voltage level of the first voltage and the voltage level of the second voltage.

The voltage level detecting unit includes a control unit and a differential amplifier unit.

The control unit receives a reference voltage and determines the voltage level of the first voltage in response to the first and second operating mode signals. The differential amplifier unit generates the control signal at a first level when the voltage level of the first voltage is higher than that of the second voltage, and generates the control signal at a second level when the voltage level of the first voltage is lower than the second voltage.

The control unit includes first through fourth resistors, a first control transistor, and a second control transistor. The first through fourth resistors are connected in series between the reference voltage and a ground voltage.

A first terminal of the first control transistor is connected between the first resistor and the second resistor, and the first operating mode signal is applied to the gate thereof. Also, a second terminal of the first control transistor is connected to a first node between the second resistor and the third resistor.

A first terminal of the second control transistor is connected between the third resistor and the fourth resistor, and the second operating mode signal is applied to the gate thereof. Also, a second terminal of the second control transistor is connected between the fourth resistor and the ground voltage.

The first voltage is a voltage level of the first node. The voltage level of the second voltage is proportional to the voltage level of the internal voltage.

BRIEF DESCRIPTION OF THE DRAWINGS

The above and other aspects, features and advantages of the present invention will become more apparent by describing in detail exemplary embodiments thereof with reference to the attached drawings, in which.

DETAILED DESCRIPTION OF PREFERRED EMBODIMENTS

Figure 1:
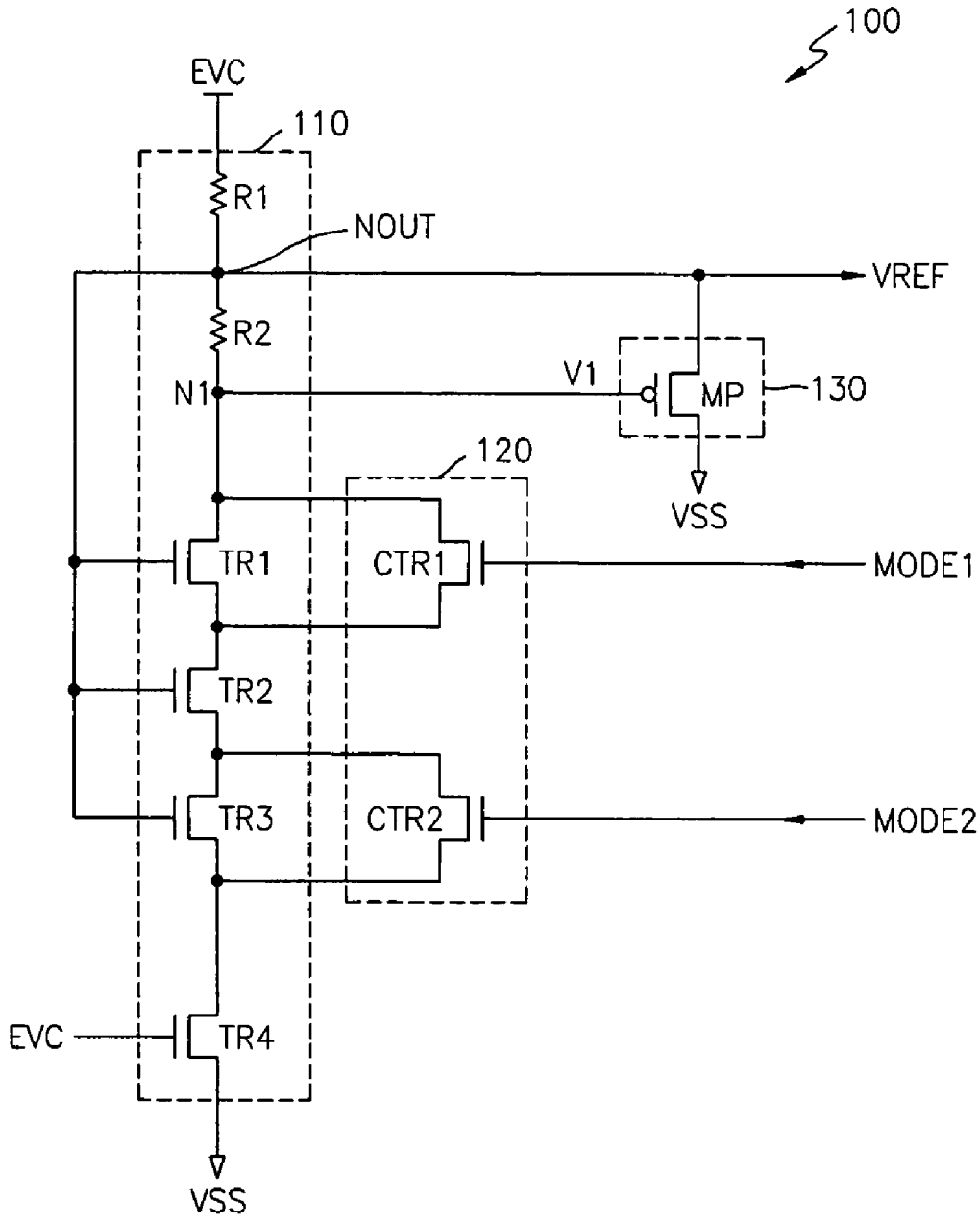
FIG. 1 shows a circuit diagram of a reference voltage generating circuit according to an embodiment of the present invention.

The present invention will now be described more fully with reference to the accompanying drawings, in which exemplary embodiments of the invention are shown. The same reference numerals in different drawings represent the same element. Embodiments of the present invention provide a reference voltage generating circuit and an internal voltage generating circuit of a semiconductor memory device for varying an interval voltage level according to an operating mode.

FIG. 1 shows a circuit diagram of a reference voltage generating circuit according to a first exemplary embodiment of the present invention.

Referring to FIG. 1, a reference voltage generating circuit 100 of the present invention comprises a distributor 110, a clamping control unit 130, and a control unit 120.

The distributor 110 generates, via an output terminal NOUT, a reference voltage VREF, which has a voltage level lower than that of an external power supply voltage EVC, and varies according to an operating mode in response to the external power supply voltage EVC.

More specifically, the distributor 110 includes a first resistor R1, a second resistor R2, and first through fourth transistors TR1, TR2, TR3, and TR4.

The first resistor R1 is connected between the external power supply voltage EVC and the output terminal NOUT. The second resistor R2 is connected between the output terminal NOUT and a first node N1 from which a control voltage V1 is generated.

The first through fourth transistors TR1, TR2, TR3, and TR4 are connected in series between the first node N1 and a ground voltage. The gates of the first through third transistors TR1, TR2, and TR3 are connected to the output terminal NOUT, and the external power supply voltage is applied to the gate of the fourth transistor TR4.

The first through fourth transistors TR1, TR2, TR3, and TR4 are NMOS transistors. The voltage level of the reference voltage VREF may be controlled by controlling a width-to-length ("W/L") ratio of each of the first through fourth transistors TR1, TR2, TR3, and TR4.

The clamping control unit 130 is connected between the output terminal NOUT and the ground voltage VSS, and clamps the voltage level of the reference voltage VREF at a constant level in response to the control voltage V1, which has a voltage level that is lower than that of the reference voltage VREF.

More specifically, the clamping control unit 130 is a PMOS transistor. The first and second ends of the PMOS transistor are connected to the output terminal NOUT and the ground voltage VSS, respectively, and the control voltage V1 is applied to the gate thereof.

The control unit 120 increases or decreases the voltage level of the reference voltage VREF in response to the first and second operating mode signals MODE2. The control unit 120 includes a first control transistor CTR1 and a second control transistor CTR2.

The first control transistor CTR1 is turned on or turned off in response to the first operating mode signal MODE1 to increase or decrease the voltage level of the reference voltage VREF. The second control transistor CTR2 is turned on or turned off in response to the second operating mode signal MODE2 to increase or decrease the voltage level of the reference voltage VREF.

The first control transistor CTR1 is an NMOS transistor. The source and drain of the NMOS transistor are connected to the source and drain of the first transistor TR1 and the first operating mode signal MODE1 is applied to the gate thereof.

The second control transistor CTR2 is an NMOS transistor. The source and drain of the NMOS transistor are connected to the source and drain of the third transistor TR3 and the second operating mode signal MODE2 is applied to the gate thereof. The first and second operating mode signals MODE1 and MODE2 are mode register set ("MRS") signals.

When the reference voltage generating circuit 100 is in a low operating frequency range, the first and second operating mode signals MODE1 and MODE2 are at a first level. When the reference voltage generating circuit 100 is in a high operating frequency range, the first and second operating mode signals MODE1 and MODE2 are at a second level. Also, when the reference voltage generating circuit 100 is in an intermediate operating frequency range, one of the first and second operating mode signals MODE1 and MODE2 is generated at the first level, and the other is generated at the second level.

Hereinafter, operations of the reference voltage generating circuit according to an embodiment of the present invention will be described with reference to FIG. 1.

A distributing unit 110 generates a reference voltage VREF via an output terminal NOUT in response to an external power supply voltage EVC. The reference voltage VREF has a voltage level lower than that of the external power supply voltage EVC, and varies according to an operating mode.

The distributing unit 110 comprises a first resistor R1, a second resistor R2, and first to fourth transistors TR1, TR2, TR3, and TR4. The first through fourth transistors TR1, TR2, TR3, and TR4 are NMOS transistors.

The first resistor R1 is connected between the external power supply voltage EVC and the output terminal NOUT. The second resistor R2 is connected between the output terminal NOUT and a first node N1 from which a control voltage V1 is generated.

The first through fourth transistors TR1, TR2, TR3, and TR4 are connected in series between the first node N1 and a ground voltage VSS. Thus, current channels are formed in series.

Gates of the first through third transistors TR1, TR2, and TR3 are connected to the output terminal NOUT, and the external power supply voltage is applied to the gate of the fourth transistor TR4.

When the external power supply voltage EVC reaches a certain voltage level, the fourth transistor TR4 is turned on. Then, a current in the distributing unit 110 flows from the external power supply voltage EVC connected to the first resistor R1 to the ground voltage VSS.

That is, the fourth transistor TR4 serves as a switch for operating the distributing unit 110.

The first through third transistors TR1, TR2, and TR3 are used as resistors. Thus, a voltage is generated at a certain level at the output terminal NOUT based on the voltage divider rule, and is called the reference voltage VREF.

The voltage level of the reference voltage VREF can be controlled by controlling the W/L ratio of each of the first through fourth transistors TR1, TR2, TR3, and TR4.

The clamping control unit 130 is connected between the output terminal NOUT and the ground voltage VSS, and clamps a voltage level of the reference voltage VREF at a constant level in response to the control voltage V1, which has a lower voltage level than that of the reference voltage VREF. The level of the control voltage V1 is controlled by the first through fourth transistors TR1, TR2, TR3, and TR4.

The clamping control unit 130 is a PMOS transistor. The first and second ends of the PMOS transistor are connected to the output terminal NOUT and the ground voltage VSS, respectively, and the control voltage V1 is applied to the gate thereof.

When the external power supply voltage EVC is increased and then maintained at a constant level, the reference voltage VREF is also maintained at a constant level.

A sudden increase in the reference voltage VREF level makes a larger difference between the voltage level of the gate of the clamping control unit 130 to which the control voltage is applied and the voltage level of the source of the clamping control unit 130 to which the reference voltage VREF is applied.

Then, the PMOS transistor MP is turned on to a greater extent, and more current flows from the source of the PMOS transistor MP to the drain. As a result, the reference voltage VREF level decreases.

Inversely, a sudden decrease in the reference voltage VREF level makes a smaller difference between the voltage level of the gate of the clamping control unit 130 to which the control voltage is applied and the voltage level of the source of the clamping control unit 130 to which the reference voltage VREF is applied.

Then, the PMOS transistor MP is turned on to a smaller extent, and less current flows from the source of the PMOS transistor MP to the drain. As a result, the reference voltage VREF level rises.

As described above, the clamping control unit 130 is used to maintain the reference voltage VREF at a constant level.

The control unit 120 increases or decreases the voltage level of the reference voltage VREF in response to the first and second operating mode signal MODE1 and MODE2. The control unit 120 includes a first control transistor CTR1 and a second control transistor CTR2.

The first control transistor CTR1 is an NMOS transistor. The source and drain of the NMOS transistor are connected to the source and drain of the first transistor TR1, respectively, and the first operating mode signal MODE1 is applied to the gate thereof.

The second control transistor CTR2 is an NMOS transistor. The source and drain are connected to the source and drain of the third transistor TR3, respectively, and the second operating mode signal MODE2 is applied to the gate thereof.

Here, for example, the operating modes of the semiconductor memory device are classified into CL2, CL2.5, and CL3, according to the operating frequency range. Thus, the reference voltage generating circuit 100 of the exemplary embodiment generates a reference voltage VREF at the lowest level in the CL2 mode, generates a reference voltage VREF at the intermediate level in the CL2.5 mode, and generates a reference voltage VREF at the highest level in the CL3 mode.

In the CL2 mode, the first and second operating mode signals MODE1 and MODE2 are at a first level. In the CL2.5 mode, one of the first and second operating mode signals MODE1 and MODE2 is at the first level, and the other is at a second level.

In the CL3 mode, the first and second operating mode signals MODE1 and MODE2 are at the second level. Here, we suppose for convenience that the first level is a high level and the second level is a low level. However, it will be apparent to those of ordinary skill in the pertinent art that the first level is not limited to the high level and the second level is not limited to the low level.

The first and second operating mode signals MODE1 and MODE2 are mode register set ("MRS") signals. If the semiconductor memory device operates in the CL2.5 mode, one of the first and second control transistors CTR1 and CTR2 is turned on and the other is turned off. Here, for example, the first control transistor CTR1 is turned on.

Thus, a current in the distributing unit 110 flows to the second transistor TR2 via the first control transistor CTR1 instead of the first transistor TR1. Accordingly, the second resistor R2, the second transistor TR2, the third transistor TR3, and the fourth transistor TR4 are used as resistors for determining the voltage level of the reference voltage VREF.

Figure 2:
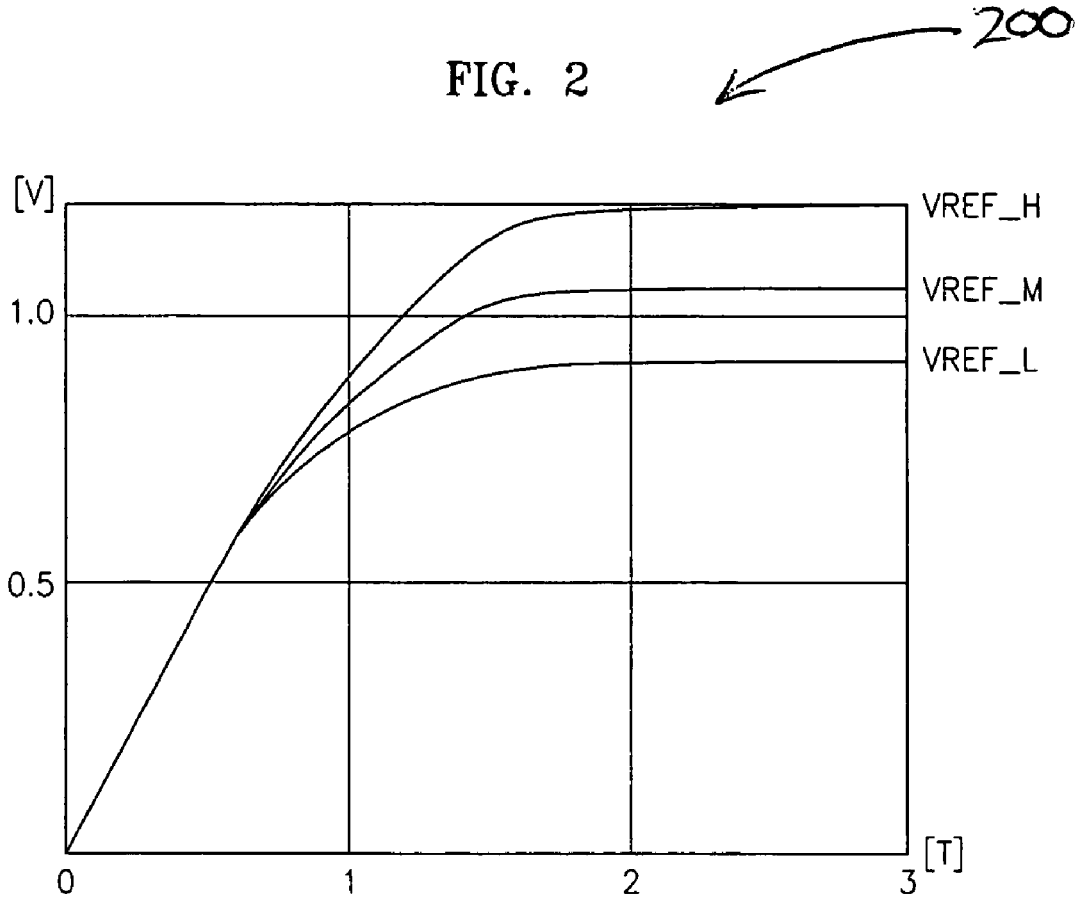
FIG. 2 shows a diagram illustrating a voltage level of a reference voltage output from the reference voltage generating circuit of FIG. 1.

FIG. 2 shows a voltage level diagram indicated generally by the reference numeral 200. The voltage diagram 200 illustrates a resulting voltage level VREF_M, for example, of the reference voltage VREF output from the reference voltage generating circuit of FIG. 1.

If the semiconductor memory device operates in CL2 mode, both the first and second control transistors CTR1 and CTR2 are turned on. This is because the first and second operating mode signals MODE1 and MODE2 are both at the high level.

Then, a current in the distributing unit 110 flows to the second transistor TR2 via the first control transistor CTR1 instead of the first transistor TR1. Also, a current in the distributing unit 110 flows to the fourth transistor TR4 via the second control transistor CTR2 instead of the third transistor TR3.

The second resistor R2, the second transistor TR2, and the fourth transistor TR4 are used as resistors for determining a voltage level of the reference voltage VREF. As the number of the resistors for determining the voltage level of the reference voltage VREF is reduced from the case where the semiconductor memory device operates in the CL2.5 mode, the reference voltage VREF level also becomes lower. The resulting level of the reference voltage VREF is indicated by VREF_L of the diagram 200.

If the semiconductor memory device operates in CL3 mode, both the first and second control transistors CTR1 and CTR2 are turned off. This is because the first and second operating mode signals MODE1 and MODE2 are both at the low level.

Then, a current in the distributing unit 110 flows to the ground voltage VSS via the first through fourth transistors TR1, TR2, TR3, and TR4. Accordingly, the second resistor R2, and the first through fourth transistors TR1, TR2, TR3, and TR4 are used as resistors for determining a voltage level of the reference voltage VREF.

As the number of the resistors for determining the voltage level of the reference voltage VREF is increased from the case where the semiconductor memory device operates in the CL2.5 mode, the reference voltage VREF level also becomes higher. The resulting reference voltage VREF level is indicated by VREF_H of the diagram 200.

The internal voltage generating circuit of the semiconductor memory device can control a voltage level of an internal voltage in response to the level of the reference voltage VREF, which varies according to an operating mode.

Figure 3:
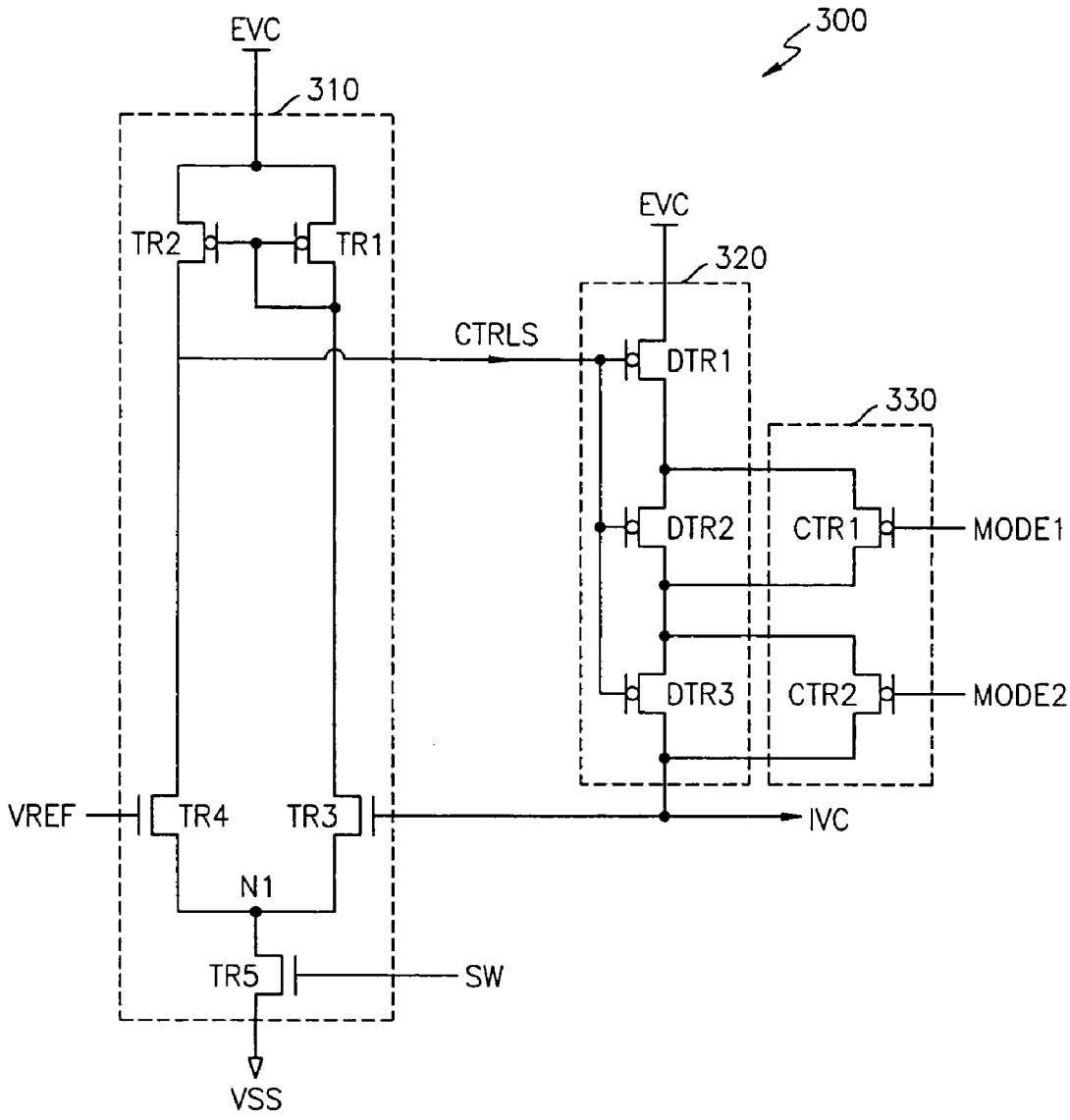
FIG. 3 shows a circuit diagram of an internal voltage generating circuit according to another embodiment of the present invention.

FIG. 3 shows a circuit diagram of an internal voltage generating circuit according to a second embodiment of the present invention.

A differential amplifier unit 310 compares a voltage level of a reference voltage VREF with a voltage level of an internal voltage IVC, generates a control signal CTRLS in response to a comparison result, and controls the voltage level of the internal voltage IVC.

More specifically, the differential amplifier unit 310 includes first through fifth transistors TR1, TR2, TR3, TR4, and TR5. A first terminal of the first transistor TR1 is connected to an external power supply voltage EVC, and the gate and a second terminal of the first transistor TR1 are connected to each other. A first terminal of the second transistor TR2 is connected to the external power supply voltage EVC, and the gate of the first transistor TR1 is connected to the gate thereof. Also, the control signal CTRLS is output from a second terminal of the second transistor TR2.

A first terminal of the third transistor TR3 is connected to the second terminal of the first transistor TR1, and the internal voltage is connected to the gate thereof. A second terminal of the third transistor TR3 is connected to a first node N1. A first terminal of the fourth transistor TR4 is connected to the second terminal of the second transistor TR2, and the reference voltage VREF is connected to the gate thereof. A second terminal of the fourth transistor TR4 is connected to the first node N1.

The fifth transistor TR5 is connected between the first node N1 and a ground voltage VSS, and a switching signal SW is applied to the gate thereof. To make the differential amplifier unit 310 operate, the switching signal SW should be input at a high level.

A distributing unit 320 increases or decreases the voltage level of the internal voltage IVC in response to the control signal CTRLS to clamp the voltage level of the internal voltage IVC at a constant level. The distributing unit 320 includes first through third distributing transistors DTR1, DTR2, and DTR3.

A first terminal of the first distributing transistor DTR1 is connected to the external power supply voltage EVC, and the control signal CTRLS is applied to the gate thereof. A first terminal of the second distributing transistor DTR2 is connected to a second terminal of the first distributing transistor DTR1, and the control signal CTRLS is applied to the gate thereof.

A first terminal of the third distributing transistor DTR3 is connected to a second terminal of the second distributing transistor DTR2, and the control signal CTRLS is applied to the gate thereof. Also, a second terminal of the third distributing transistor DTR3 is connected to the internal voltage IVC.

If the reference voltage VREF is at a higher level than the internal voltage IVC, the differential amplifier unit 310 outputs the control signal CTRLS at a low level. Then, the first through third distributing transistors DTR1, DTR2, and DTR3 are turn on. Accordingly, the internal voltage IVC level increases.

Inversely, if the reference voltage VREF is at a lower level than the internal voltage IVC, the differential amplifier unit 310 outputs the control signal CTRLS at a high level. Then, the first through third distributing transistors DTR1, DTR2, and DTR3 are turn off. Accordingly, the internal voltage IVC level decreases.

The voltage level of the internal voltage IVC is controlled by controlling a width-to-length ratio of each of the first through third distributing transistors DTR1, DTR2, and DTR3.

As described above, the voltage level of the internal voltage IVC may increase or decrease due to the differential amplifier unit 310 and the distributing unit 320.

Also, by using a first operating mode signal MODE1 and a second operating mode signal MODE2, the voltage level of the internal voltage IVC can be controlled according to an operating mode.

A control unit 330 increases or decreases the voltage level of the internal voltage IVC in response to the first and second operating mode signals MODE1 and MODE2. The control unit 330 includes a first control transistor CTR1 and a second control transistor CTR2.

The first control transistor CTR1 is turned on or turned off in response to the first operating mode signal MODE1 to increase or decrease the voltage level of the internal voltage IVC. The second control transistor CTR2 is turned on or turned off in response to the second operating mode signal MODE2 to increase or decrease the voltage level of the internal voltage IVC.

The first control transistor CTR1 is a PMOS transistor. A first terminal and a second terminal of the PMOS transistor are respectively connected to the first terminal and the second terminal of the second distributing transistor DTR2, and the first operating mode signal MODE1 is applied to the gate thereof.

The second control transistor CTR2 is a PMOS transistor. A first terminal and a second terminal of the PMOS transistor are respectively connected to the first terminal and the second terminal of the third distributing transistor DTR3, and the second operating mode signal MODE2 is applied to the gate thereof.

The first and second operating mode signals MODE1 and MODE2 are mode register set ("MRS") signals.

We suppose here that the operating modes of the semiconductor memory device are classified into CL2, CL2.5, and CL3, according to the operating frequency range. Here, the internal voltage generating circuit 300 of the present invention generates an internal voltage IVC at the lowest level in the CL2 mode, generates an internal voltage IVC at the intermediate level in the CL2.5 mode, and generates an internal voltage IVC at the highest level in the CL3 mode.

In the CL2 mode, the first and second operating mode signals MODE1 and MODE2 are at a first level. In the CL2.5 mode, one of the first and second operating mode signals MODE1 and MODE2 is at the first level, and the other is at a second level.

In the CL3 mode, the first and second operating mode signals MODE1 and MODE2 are at the second level. It is supposed for convenience that the first level is a high level and the second level is a low level. However, the first level is not limited to the high level and the second level is not limited to the low level.

That is, if the first and second operating mode signals MODE1 and MODE2 are at the low level, both the first and second control transistors CTR1 and CTR2 are turned on. Then, resistance in a current path through the distributing unit 320 between the external power supply voltage EVC and the internal voltage IVC becomes low.

This is because only the first distributing transistor DTR1 is used as a resistor. Accordingly, more current flows in the current path through the distributing unit 320 and thus the voltage level of the internal voltage IVC increases.

Inversely, in the CL2 mode, if the first and second operating mode signals MODE1 and MODE2 are at the high level, both the first and second control transistors CTR1 and CTR2 are turned off. Then, resistance in a current path through the distributing unit 320 between the external power supply voltage EVC and the internal voltage IVC becomes high.

This is because the first through third distributing transistors DTR1, DTR2, and DTR3 are used as resistors. Accordingly, less current flows in the current path through the distributing unit 320 and thus the voltage level of the internal voltage IVC decreases.

In the CL2.5 mode, if one of the first and second operating mode signals MODE1 and MODE2 is at the high level and the other is at the low level, one of the first and second control transistors CTR1 and CTR2 is turned on and the other is turned off.

Then, resistance in a current path through the distributing unit 320 becomes intermediate between the resistances in the CL2 mode and the CL3 mode. Accordingly, the voltage level of the internal voltage IVC is intermediate between the voltage levels of the internal voltage IVC in the CL2 mode and the CL3 mode.

Since the first and second operating mode signals MODE1 and MODE2 are controlled according to an operating mode, the internal voltage IVC can be at an appropriate voltage level according to the operating frequency of the semiconductor memory device by controlling the first and second operating mode signals MODE1 and MODE2.

Unlike the reference voltage generating circuit 100 of FIG. 1, which affects the voltage levels of all internal voltage generating circuits receiving the reference voltage VREF, the internal voltage generating circuit 300 of FIG. 3 has an advantage of controlling only the voltage level of a required internal voltage generating circuit.

Figure 4:
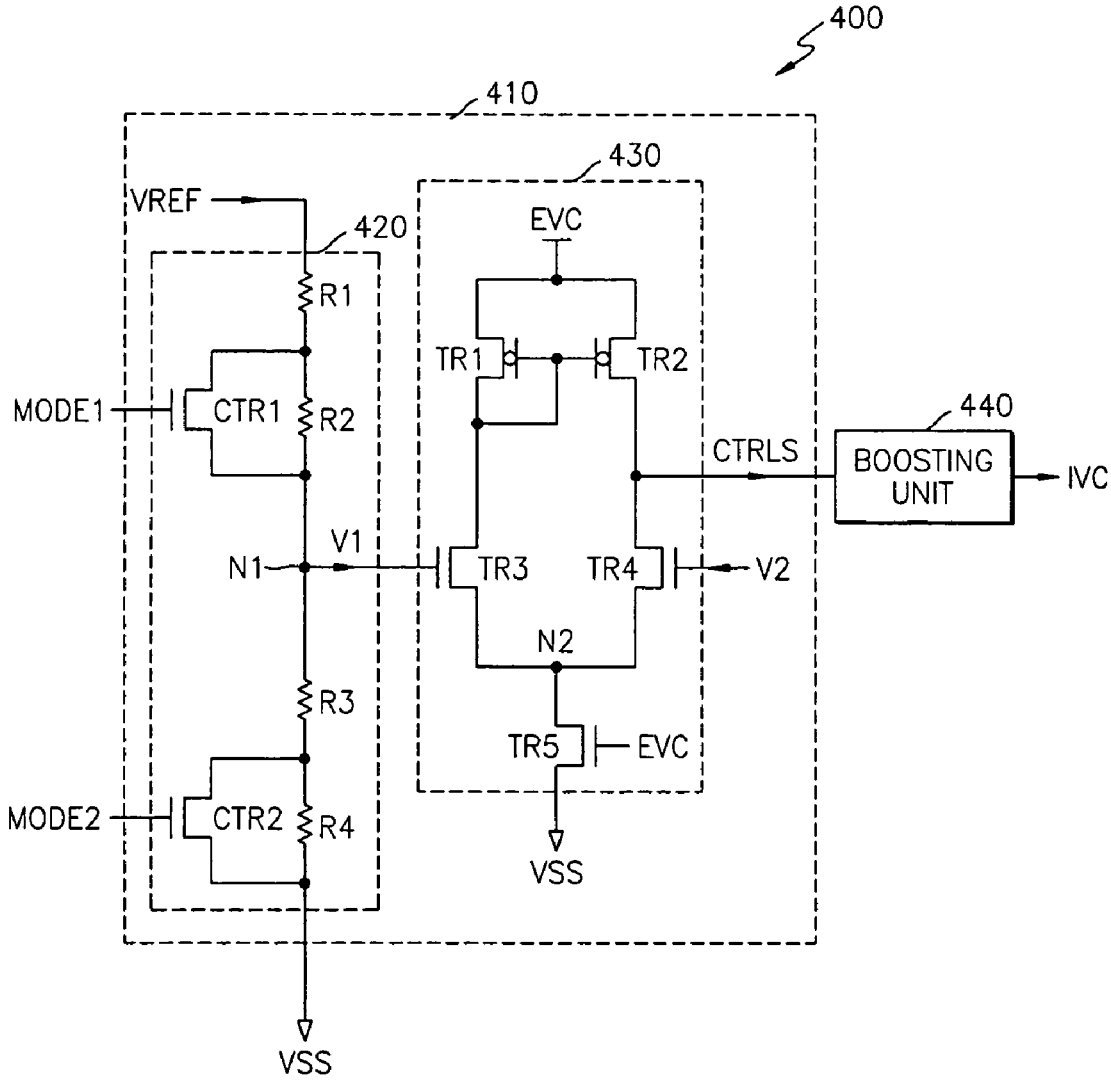
FIG. 4 shows a circuit diagram of an internal voltage generating circuit according to yet another embodiment of the present invention.

FIG. 4 shows a circuit diagram of an internal voltage generating circuit according to yet another embodiment of the present invention.

The internal voltage generating circuit 400 of FIG. 4 generates an internal voltage IVC, which has a higher voltage level than that of an external power supply voltage EVC. To perform this operation, a voltage level detecting unit 410 determines a voltage level of a first voltage V1 in response to first and second operating mode signals MODE1 and MODE2, compares the voltage level of the first voltage V1 with a voltage level of a second voltage V2, and controls the voltage level of the internal voltage IVC, which is higher than that of the external power supply voltage.

The voltage level detecting unit 410 includes a control unit 420 and a differential amplifier unit 430. The control unit 420 receives a reference voltage VREF and determines the voltage level of the first voltage V1 in response to the first and second operating mode signals MODE1 and MODE2.

The differential amplifier unit 430 generates a control signal CTRLS at a first level when the voltage level of the first voltage V1 is higher than that of the second voltage V2, and generates the control signal CTRLS at a second level when the voltage level of the first voltage V1 is lower than that of the second voltage V2.

The control unit 420 includes first through fourth resistors R1, R2, R3, and R4, a first control transistor CTR1, and a second control transistor CTR2.

A first terminal of the first control transistor CTR1 is connected between the first resistor R1 and the second resistor R2, and the first operating mode signal MODE1 is applied to the gate thereof. A second terminal of the first control transistor CTR1 is connected to a first node N1 between the second resistor R2 and the third resistor R3.

A first terminal of the second control transistor CTR2 is connected between the third resistor R3 and the fourth resistor R4, and the second operating mode signal MODE2 is applied to the gate thereof. A second terminal of the second control transistor CTR2 is connected between the fourth resistor R4 and a ground voltage VSS.

The first voltage V1 is a voltage level of the first node N1. The voltage level of the first voltage V1 is determined by a resistance ratio of the first through fourth resistors R1, R2, R3, and R4. The voltage level of the second voltage V2 is proportional to that of the internal voltage IVC.

If the voltage level of the first voltage V1 is higher than that of the second voltage V2, since a fourth transistor TR4 allows less current to flow than a third transistor TR3, the differential amplifier unit 430 outputs the control signal CTRLS at a first level. Here, the first level is a high level.

A boosting unit 440 is turned on in response to the control signal CTRLS having the high level and generates the internal voltage IVC at a higher level than the external power supply voltage EVC.

If the voltage level of the first voltage V1 is lower than that of the second voltage V2, since the fourth transistor TR4 allows more current to flow than the third transistor TR3, the differential amplifier unit 430 outputs the control signal CTRLS at a second level. Here, the second level is a low level.

The boosting unit 440 is turned off in response to the control signal CTRLS having the low level. Then, the internal voltage IVC is maintained at the present voltage level. By these operations, the internal voltage IVC can be maintained at a higher voltage level than the external power supply voltage EVC.

If the level of the internal voltage IVC decreases, the voltage level of the second voltage V2 also decreases. Then, the differential amplifier unit 430 outputs the control signal CTRLS at a high level to increase the voltage level of the internal voltage IVC. On the other hand, if the voltage level of the internal voltage IVC increases, the voltage level of the second voltage V2 also increases. Then, the differential amplifier unit 430 outputs the control signal CTRLS at a low level to turn off the boosting unit 440, thereby preventing the voltage level of the internal voltage IVC from increasing.

In the internal voltage generating circuit 400, the voltage level of the internal voltage IVC can be controlled according to an operating mode of the semiconductor memory device. That is, the voltage level of the internal voltage IVC increases in a high operating frequency range and decreases in a low operating frequency range.

When the internal voltage generating circuit 400 is in the high operating frequency range, the first operating mode signal MODE1 is at a first level and the second operating mode signal MODE2 is at a second level. Here, the second level is a low level and the first level is a high level but the present embodiment is not limited thereto.

The first and second operating mode signals are mode register set ("MRS") signals. If the first operating mode signal MODE1 is at the first level and the second operating mode signal MODE2 is at the second level, the voltage level of the first node N1, i.e., the voltage level of the first voltage V1 increase.

Thus, the differential amplifier unit 430 outputs the control signal CTRLS at a high level, and the boosting unit 440 is turned on to increase the voltage level of the internal voltage IVC. Accordingly, the voltage level of the internal voltage IVC can be increased in the high operating frequency range.

Inversely, when the internal voltage generating circuit 400 is in a low operating frequency range, the first operating mode signal MODE1 is at the second level and the second operating mode signal MODE2 is at the first level. Then, the voltage level of the first node N1, i.e., the voltage level of the first voltage V1 decrease.

Thus, the differential amplifier unit 430 outputs the control signal CTRLS at a low level and the boosting unit 440 is turned off. Accordingly, the voltage level of the internal voltage IVC can be held low in the low operating frequency range.

Since the first and second operating mode signals MODE1 and MODE2 are controlled according to an operating mode, the internal voltage IVC can be at an appropriate voltage according to the operating frequency of the semiconductor memory device by controlling the first and second operating mode signals MODE1 and MODE2.

Also, the internal voltage generating circuit 400 of FIG. 4 has an advantage of maintaining the internal voltage IVC at a higher level than the external power supply voltage EVC.

As described above, the reference voltage generating circuit and the internal voltage generating circuit of the present invention can control internal voltage level according to the operating mode of the semiconductor memory device. Thus, the operating characteristics of the semiconductor memory device can be improved in some operating modes, while power dissipation can be minimized in other operating modes.

While the present invention has been particularly shown and described with reference to preferred embodiments thereof, it will be understood by those of ordinary skill in the pertinent art that various changes in form and details may be made therein without departing from the spirit and scope of the present invention as defined by the following claims.

What is claimed is:

1. A reference voltage generating circuit, comprising:

a distributing unit which generates via an output terminal a reference voltage, which has a lower voltage level than that of an external power supply voltage and varies according to an operating mode, in response to the external power supply voltage;

a clamping control unit connected between the output terminal and a ground voltage, the clamping control unit for clamping a voltage level of the reference voltage at a constant level in response to a control voltage having a voltage level which is lower than that of the reference voltage; and a control unit connected to the distributing unit for increasing or decreasing a voltage level of the reference voltage in response to first and second operating mode signals by controlling the operating mode of the distributing unit, wherein:

in a low operating frequency range, the first and second operating mode signals are at a first level;

in a high operating frequency range, the first and second operating mode signals are at a second level; and in an intermediate frequency range, one of the first and second operating mode signals is at the first level and the other is at the second level.

2. The circuit of claim 1 wherein the distributing unit has an enabling switch with a control terminal connected to the external power supply voltage.

3. The circuit of claim 1 wherein the distributing unit comprises:

a first resistor connected between the external power supply voltage and the output terminal;

a second resistor connected between the output terminal and a first node from which the control voltage is output; and first through fourth transistors connected in series between the first node and the ground voltage, wherein the control terminals of the first through third transistors are connected to the output terminal, and wherein the external power supply voltage is applied to the control terminal of the fourth transistor.

4. The circuit of claim 3, wherein the first through fourth transistors are NMOS transistors.

5. The circuit of claim 3, wherein the voltage level of the reference voltage is controlled by controlling a width-to-length ratio of each of the first through fourth transistors.

6. The circuit of claim 3, wherein the control unit comprises:

a first control transistor which is turned on or turned off in response to the first operating mode signal to increase or decrease the reference voltage level; and a second control transistor which is turned on or turned off in response to the second operating mode signal to increase or decrease the reference voltage level.

7. The circuit of claim 6, wherein the first control transistor is an NMOS transistor, and the source and the drain of the NMOS transistor are connected to the source and the drain of the first transistor and the first operating mode signal is applied to the gate of the NMOS transistor.

8. The circuit of claim 6, wherein the second control transistor is an NMOS transistor, and the source and the drain of the NMOS transistor are connected to the source and the drain of the third transistor and the second operating mode signal is applied to the gate of the NMOS transistor.

9. The circuit of claim 1, wherein the clamping control unit is a PMOS transistor, and the first and second ends of the PMOS transistor are connected to the output terminal and the ground voltage, respectively, and the control voltage is applied to the gate of the PMOS transistor.

10. The circuit of claim 1, wherein the first and second operating mode signals are mode register set ("MRS") signals.

11. A voltage generating circuit comprising:

mode means for controlling a voltage level of at least one of a first, a second and a third voltage in response to a plurality of operating mode signals;

comparison means for comparing the voltage level of the first voltage with the voltage level of the second voltage; and adjusting means for controlling the voltage level of the third voltage in response to at least one of the mode means and the comparison means, wherein:

in a low operating frequency range, first and second of the plurality of operating mode signals are at a first level;

in a high operating frequency range, the first and second of the plurality of operating mode signals are at a second level; and in an intermediate frequency range, one of the first and second of the plurality of operating mode signals is at the first level and the other is at the second level.

12. A circuit as defined in claim 11 wherein:

the mode means comprises a control unit;

the comparison means comprises a distributing unit; and the adjusting means comprises a clamping control unit.

13. A circuit as defined in claim 11 wherein:

the mode means comprises a control unit;

the comparison means comprises a differential amplifier unit; and the adjusting means comprises a distributing unit.

14. A circuit as defined in claim 11 wherein:

the mode means comprises a voltage level detecting unit;

the comparison means comprises the voltage level detecting unit; and the adjusting means comprises a boosting unit.

* * * * *